US005264658A

United States Patent [19]

Umeyama et al.

[11] Patent Number: 5,264,658

[45] Date of Patent: Nov. 23, 1993

[54] ELECTRONIC MUSICAL INSTRUMENT HAVING FREQUENCY DEPENDENT TONE CONTROL

[75] Inventors: Yasuyuki Umeyama; Iwao Higashi, both of Hamamatsu, Japan

[73] Assignee: Yamaha Corporation, Hamamatsu, Japan

[21] Appl. No.: 778,584

[22] Filed: Oct. 17, 1991

[30] Foreign Application Priority Data

Oct. 18, 1990 [JP] Japan ..... 2-280102

[51] Int. Cl.[5] ..... G10H 1/12

[52] U.S. Cl. ..... 84/661; 84/DIG. 9; 84/DIG. 10

[58] Field of Search ..... 84/622-625, 84/630, 661-665, 699, 700, 707, 735-741, DIG. 9, DIG. 10, DIG. 26; 364/724.15, 724.16

[56] References Cited

U.S. PATENT DOCUMENTS

| | | | |
|---|---|---|---|
| 4,984,276 | 1/1991 | Smith | 84/630 X |
| 5,117,729 | 6/1992 | Kunimoto | 84/661 X |
| 5,131,310 | 7/1992 | Kunimoto | 84/661 X |

FOREIGN PATENT DOCUMENTS

| | | |
|---|---|---|
| 248527 | 4/1987 | European Pat. Off. . |
| 54-131921 | 10/1979 | Japan . |
| 58-47109 | 10/1983 | Japan . |
| 63-40199 | 2/1988 | Japan . |

*Primary Examiner*—Stanley J. Witkowski
*Attorney, Agent, or Firm*—Graham & James

[57] ABSTRACT

An electronic musical instrument includes an excitation circuit, a closed loop circuit, a characteristics analysis circuit and a control circuit. The excitation circuit generates an excitation signal in response to performance information. The closed loop circuit causes the excitation signal inputted from the excitation circuit to circulate thereabout musical tone signal. The closed loop circuit also has a delay circuit for delaying the musical tone signal for a predetermined time. The characteristics analysis circuit analyzes an input signal and generates a control signal corresponding to the result of the analysis of the input signal. The control circuit controls characteristics of the musical tone signal circulating in the closed loop circuit in response to the control signal. The musical tone signal circulating in the closed loop circuit is then outputted therefrom as a sound signal.

10 Claims, 4 Drawing Sheets

ELECTRONIC MUSICAL INSTRUMENT HAVING FREQUENCY DEPENDENT TONE CONTROL

BACKGROUND OF THE INVENTION

1. Field of the Invention

The present invention relates to electronic musical instruments, and more particularly, to electronic musical instruments capable of simulating the sound of conventional non-electronic musical instruments with high fidelity.

2. Prior Art

Due to recent technological improvements, tone generating devices employed in electronic musical instruments have become available which are capable of synthesizing a wide variety of musical tones. For example, tone generating devices are conventionally known which synthesize tones which effectively simulate the sound of a conventional non-electronic musical instrument by simulating the mechanism of sound production in the target non-electronic instrument.

One example of such a conventional tone generating device suitable for simulating the sound generating mechanism of conventional stringed instruments is shown in the block diagram of FIG. 8. In this figure, an excitation signal generating circuit 1*a* can be seen which includes waveform memory wherein excitation signal waveforms such as impulse waveforms are stored which are made up of a large number of different high frequency components. Additionally, the illustrated device includes a closed loop circuit consisting of an adder 2, delay circuit 3 and filter 4.

Excitation signals output from excitation signal generating circuit 1*a* are supplied to the closed loop circuit via an input terminal of adder 2. The output signal from adder 2 is supplied to delay circuit 3 which simulates the delay of propagation of vibrating waves in a string of the target stringed instrument. The delayed output signal of delay circuit 3 is then supplied to filter 4 which simulates acoustical losses of a vibrating string of the target instrument. The output signal of the filter 4 is then supplied to a second input terminal of adder 2, in this way forming a closed loop. In addition to delay circuit 3, the output signal of adder 2 is supplied to a sound signal output terminal 5, whereby a musical tone signal circulating in the closed loop can be sampled to generate an output signal.

With the conventional tone generating device described above; after an excitation signal from excitation signal generating circuit 1*a* is supplied to adder 2, the excitation signal thus input into the closed loop begins to circulate thereabout, such that the time required for the signal to travel around the closed loop one time is equal to the period of oscillation of the vibrating string being simulated. An example of the above described type of tone generating device has been disclosed in Japanese Patent Application Second Publication, Serial No. Sho-58-48109.

An example of a conventional tone generating device suitable for simulating the sound generating mechanism of woodwind instruments is shown in the block diagram of FIG. 9, wherein an excitation signal generating circuit 1*b* can be seen similar to the excitation signal generating circuit 1*a* described above. In the case of the device shown in FIG. 9, the output signal of the excitation signal generating circuit 1*b* is supplied to a loop circuit via a subtracter 7 and an adder 8, both of which are components of the loop circuit. As FIG. 9 shows, immediately between subtracter 7 and adder 8, a nonlinear element 6 is included as a component of the loop circuit which simulates the nonlinear characteristics of a reed which is the sound generating element in the woodwind instrument under simulation. Subtracter 7 and adder 8 on either side of nonlinear element 6 simulate the application of air pressure to the reed in the instrument being simulated.

Delay circuits 9 through 12 can be seen, each consisting of, for example, multiple stage shift registers. These delay circuits 9 through 12 simulate the delay of transmission of air pressure waves in tubular portions of the simulated wind instrument. Delay circuits 9 and 10 correspond to tubular portions of the instrument tubes nearest to the reed, while delay circuits 11 and 12 correspond to those farthest from the reed. Delay circuit 9 receives the output signal from adder 8, whereas delay circuit 10 supplies an input signal to subtracter 7 wherein the output of delay circuit 10 is subtracted from the output signal from excitation signal generating circuit 1*b*.

A junction circuit 13 is incorporated into the loop circuit which simulates the scattering of air pressure waves caused by variations in the diameter of tubular portions of the woodwind instrument being simulated. In this junction circuit 13, a fourth order multiplier lattice is used which consists of multipliers $\mathbf{14}_1$–$\mathbf{14}_4$ having multiplication coefficients $K_1$–$K_4$, respectively, controlled by a control circuit (not shown), and which correspond to wave scattering characteristics of tubular portions of differing diameters. Junction circuit 13 additionally includes an adder $\mathbf{15}_1$ which adds the output of multiplier $\mathbf{14}_1$ to the output of multiplier $\mathbf{14}_4$, and an adder $\mathbf{15}_2$ which adds the output of multiplier $\mathbf{14}_2$ to the output of multiplier $\mathbf{14}_3$. The output signal from the above mentioned delay circuit 9 is transmitted to the delay circuit 11 via multiplier $\mathbf{14}_1$ and the output signal from above mentioned delay circuit 12 is transmitted to delay circuit 10 via multiplier $\mathbf{14}_2$.

A filter 16 is provided in the loop circuit of the tone generating device shown in FIG. 9 which simulates acoustical losses in the tubular portions of the simulated woodwind instrument reflecting the physical configuration thereof. A multiplier 17 intervenes between filter 16 and delay circuit 12 which serves to simulate such factors as dissipation of acoustical energy which takes place when pressure waves are reflected from the terminal portions of the woodwind instrument. The multiplication coefficient g1 of multiplier 17 is controlled by the previously mentioned control circuit, and the output signal from delay circuit 11 is multiplied thereby, the result of which is then supplied to delay circuit 12. An example of the type of tone generating device thus described has been disclosed in Japanese Patent Application First Publication, Ser. No. Sho-63-40199.

As was described above, filter 4 employed in the conventional tone generating device shown in FIG. 8 and filter 16 employed in that shown in FIG. 9 act to simulate the acoustical losses which occur in a vibrating string of a simulated string instrument, and acoustical losses affecting pressure waves in the tubular portions of a simulated woodwind instrument, respectively. Because such acoustical losses have time varying characteristics, filters which simulate such losses tend to be quite complex. This is especially problematic when simulating losses having a complicated envelope describing time dependent filter characteristics, such that the necessary filter circuits must often be of third order and higher, with exceedingly complex structures and design requirements. As a consequence, unless such highly complex and therefore expensive filters are made use of, the sound of the target non-electronic instruments can be simulated with only limited fidelity, such that the achieved effect tends to sound unnatural.

Accordingly, there is a significant demand for tone generating devices to be used in electronic musical instruments which simulate the sound of one or more target non-electronic musical instruments by simulating the mechanism of sound production thereof, which can produce a highly natural sounding musical effect which simulates the sound of the target instruments with exceedingly high fidelity, and furthermore, which do not require the use of highly complex electronic filtering circuits in order to accurately simulate time varying acoustical losses which occur in the target instruments.

SUMMARY OF THE INVENTION

In consideration of the above, it is an object of the present invention to provide an electronic musical instrument which is capable of synthesizing a wide range of musical effects with high fidelity and with an extremely natural sound, including simulation of a variety of non-electronic musical instruments having complex time varying timbre characteristics, and moreover, which does not require highly complex tone generating elements.

To satisfy this object, the present invention provides an electronic musical instrument comprising an excitation means for generating an excitation signal in response to performance information, a closed loop circuit into which said excitation signal is inputted and caused to circulate thereabout as a musical tone signal, the closed loop circuit having a delay means for delaying the musical tone signal for a predetermined time, a characteristics analysis means for analyzing an input signal and generating a control signal in response to the characteristics analysis, and a control means for controlling characteristics of the musical tone signal circulating in the closed loop circuit in response to the control signal.

According to such a structure, the excitation circuit generates an excitation signal in response to performance information. The closed loop circuit causes the excitation signal inputted from the excitation circuit to circulate thereabout musical tone signal. The closed loop circuit also has a delay circuit for delaying the musical tone signal for a predetermined time. The characteristics analysis circuit analyzes an input signal and generates a control signal corresponding to the result of the analysis of the input signal. The control circuit controls characteristics of the musical tone signal circulating in the closed loop circuit in response to the control signal. The musical tone signal circulating in the closed loop circuit is then outputted therefrom as a sound signal.

According to the present invention, there is the positive effect that the structure of the device does not get too big and that there is a greater possibility of musical expression.

Furthermore, there is the positive effect which allows a variety of sound variations.

DETAILED DESCRIPTION OF THE PREFERRED EMBODIMENTS

Figure 1:
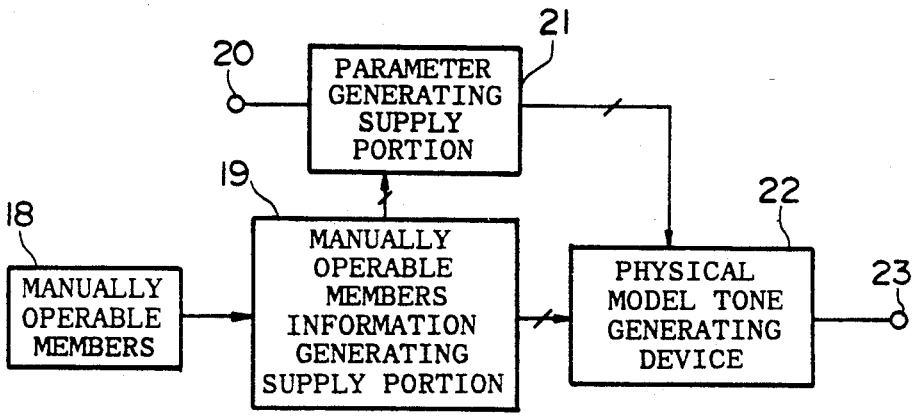
FIG. 1 shows a block diagram of the structure of the electronic musical instrument based on the preferred embodiment of the present invention.

Hereinafter, an explanation of the preferred embodiment of the present invention is given by referring to the figures. FIG. 1 shows a block diagram of the structure of an electronic instrument in accordance with the preferred embodiment of the present invention. In this figure, there are shown manually operable members 18 of parts such as the keyboard attached to the electronic musical instrument's main body, and an manually operable members information generating supply portion 19 for detecting the operation of all kinds of manually operable members 18 and accordingly generating and supplying manually operable members information (key code KC, key-on signal KON, etc.).

Furthermore, there is an outer signal input terminal 20 where outer signals such as sound signals according to the sound of a player is inputted. and a parameter generating supply portion 21 generating and supplying various parameters for analyzing such things as frequency spectrum of outer signals inputted from outer signal input terminal 20 and for controlling physical model tone generating device 22. There is a musical tone signal output terminal 23 to which the musical tone signal outputted from tone generating device 22 is outputted.

Figure 2:
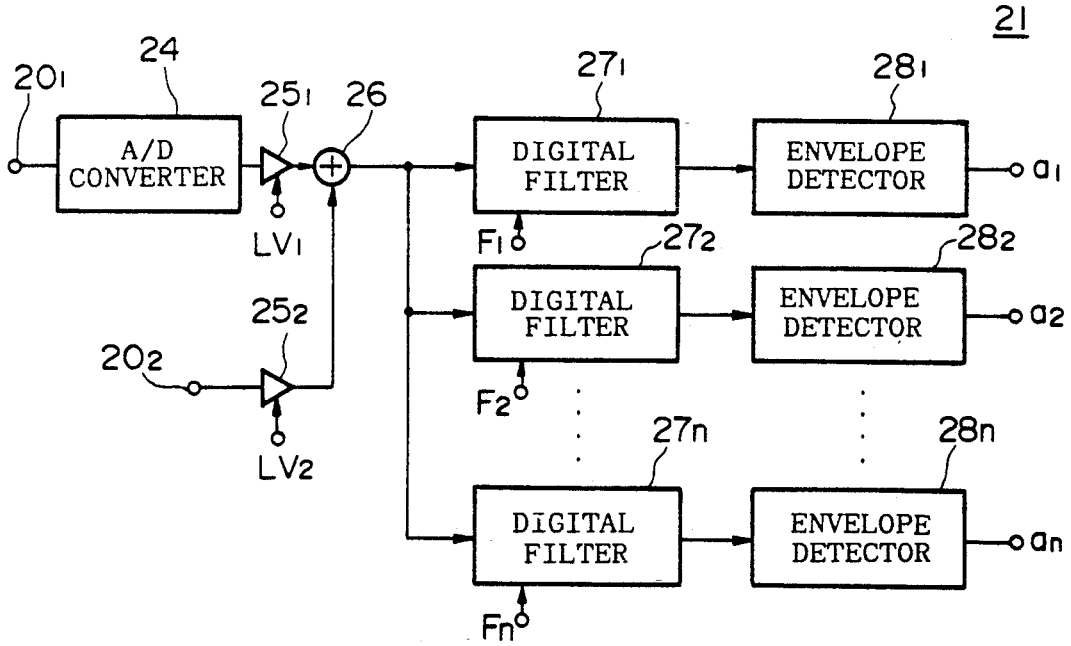
FIG. 2 shows a block diagram of the structure of the parameter generating supply portion 21 of FIG. 1.

Next, FIG. 2 shows a block diagram of the construction of parameter generating supply portion 21. In this figure there is an A/D converter 24 which converts the outer signal inputted from outer signal input terminal $\mathbf{20}_1$ into digital data, a multiplier $\mathbf{25}_1$ which multiplies the output signal from A/D converter 24 with the proportional constant $LV_1$ supplied by manually operable members information generating supply portion 19, a multiplier $\mathbf{25}_2$ multiplying the digital outer signal inputted by outer signal input terminal $\mathbf{20}_2$ with proportional constant $LV_2$ supplied by manually operable members information generating supply portion 19, and an adder 26 adding the output signal from multiplier $\mathbf{25}_1$ to the output signal of multiplier $\mathbf{25}_2$.

Figure 3:
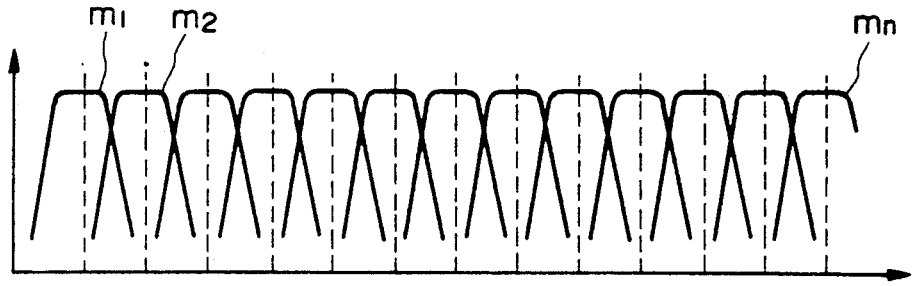
FIG. 3 shows an example of the characteristics of filter $\mathbf{27}_1$–$\mathbf{27}_n$ and $\mathbf{31}_1$–$\mathbf{31}_n$.

Furthermore, there are digital filters $\mathbf{27}_1$–$\mathbf{27}_n$ the central frequencies of which are different from each other as shown for each in FIG. 3; curve $m_1$ of FIG. 3 is the characteristic of filter $\mathbf{27}_1$; curve $m_2$ the characteristic of filter $7_2$ and curve $m_n$ the characteristic of filter $\mathbf{27}_n$.

Moreover, the characteristics of filters $27_1$–$27_n$ (cut-off frequencies and coefficients) are controlled by parameters $F_1$–$F_n$ which are supplied by operation element information generating supply portion 19.

Figure 4:
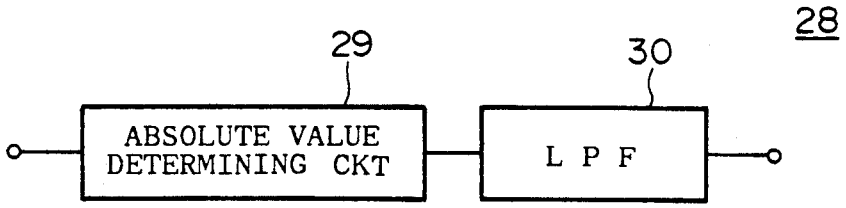
FIG. 4 shows a block diagram of a structure example of envelop detector 28.

Furthermore, there are envelop detectors $28_1$–$28_n$ extracting the level and the envelop from the analysis result of the frequency components each outputted from filters $27_1$–$27_n$ and outputting the extraction results $a_1$–$a_n$ as control parameters of tone generating device 22. As shown in FIG. 4, for example, envelop detectors $28_1$–$28_n$ are made up of absolute value determining circuit 21 rectifying the input signal and low-pass filter 30 (called LPF hereafter) smoothing (low-pass filtering) the output signal of absolute value determining circuit 29.

Figure 5:
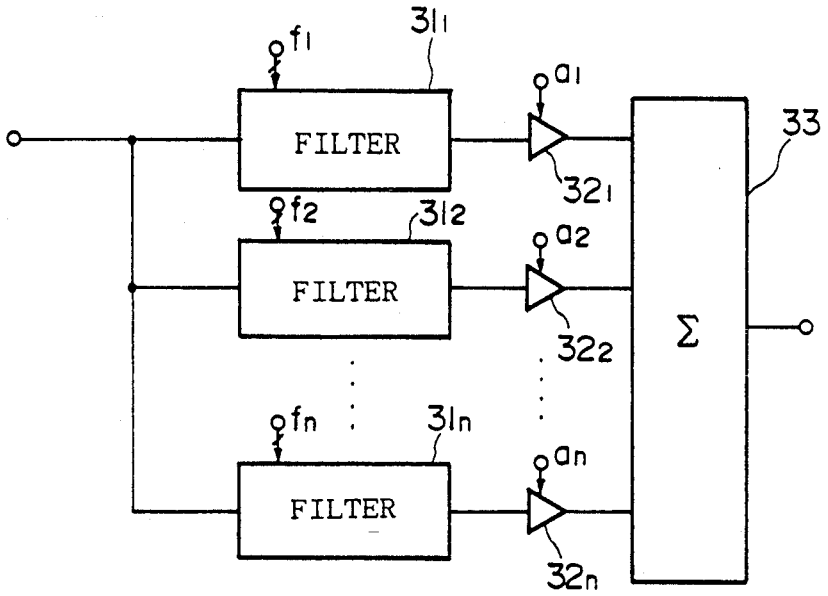
FIG. 5 shows a block diagram of a structure example of the filter portion of the physical model tone generating device.
Figure 8:
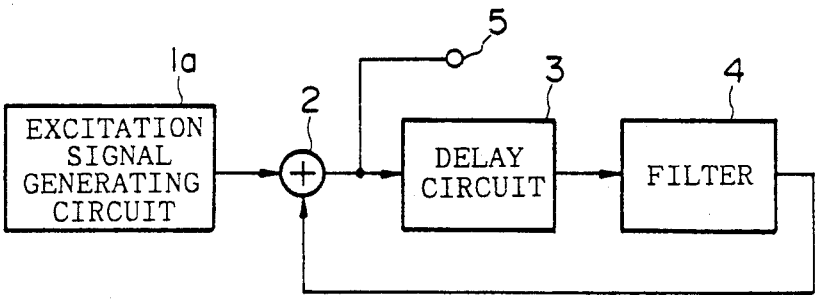
FIG.8 ( PRIOR ART )
FIG. 8 shows a block diagram of a structure example of the physical model tone generating device which a prior art simulating a string instrument.
Figure 9:
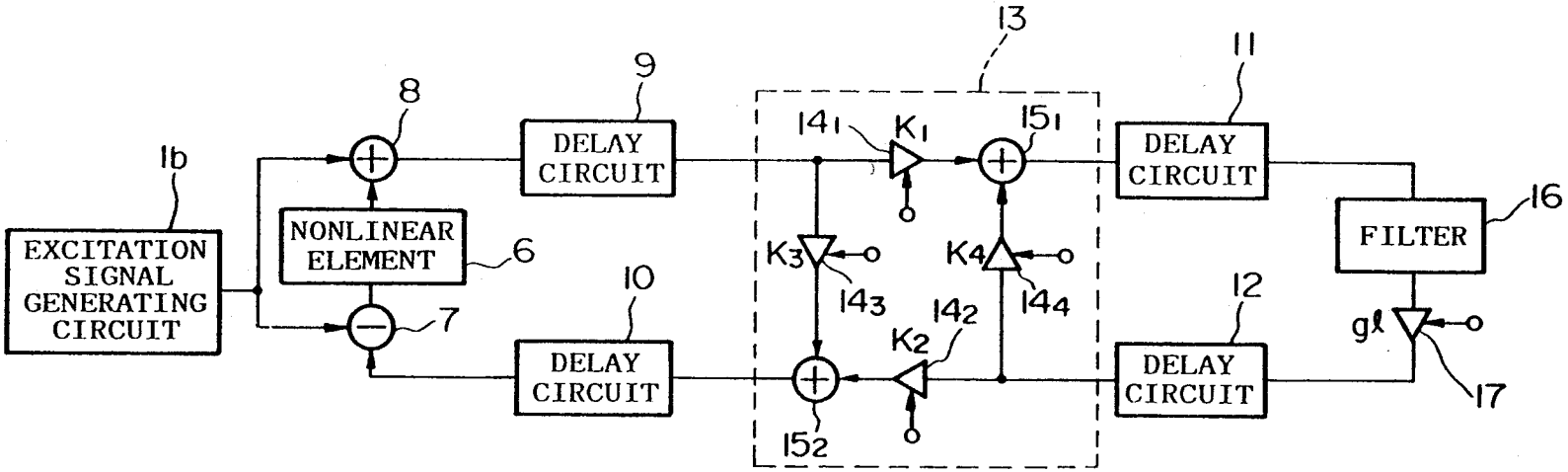
FIG. 9 ( PRIOR ART )
FIG. 9 shows a block diagram of a structure example of the physical model tone generating device which is a prior art simulating a wind instrument.

Next, FIG. 5 shows a block diagram of the construction of the filter portion of the physical model tone generating device controlled by parameters $a_1$–$a_n$ outputted from aforementioned parameter generating supply portion 21. The structure of another portion of the physical model tone generating device is a structure of prior art shown as an example in FIGS. 8 and 9.

In FIG. 5 there are filters $31_1$–$31_n$ respectively similar to filters $27_1$–$27_n$ and mutually differing in their center frequency shown in FIG. 3. Moreover, the characteristics of filters $31_1$–$31_n$ (cut-off frequencies and coefficients are controlled by parameters $f_1$–$f_n$ supplied by operation element information generating supply portion 19.

Furthermore, there are multipliers $32_1$–$32_n$ multiplying the output signals of $31_1$–$31_n$ each with the proportional constants which are parameters $a_1$–$a_n$ supplied by parameter generating supply portion 21, and a mixer 33 mixing the output signals of multipliers $32_1$–$32_n$.

When the player operates varies manually operable members 18, a key board for example, and produces a sound in direction to the not shown microphone, in the microphone the sound is changed to a sound signal and then outputted as an outer signal to outer signal input terminal $20_1$ of FIG. 2.

Thus, after the sound signal inputted from outer signal input terminal $20_1$ has been changed to digital data in the A/D converter 24, it is multiplied in multiplier $25_1$ with proportional constant $LV_1$ supplied by the operation element information generating supply portion 19. At this time, as the need arises, the digital outer signal is inputted from the outer signal input terminal $20_2$. Thus, the digital outer signal inputted from the outer signal input terminal $20_2$ after having been multiplied in the multiplier $25_2$ with proportional constant $LV_2$ supplied by the operation element information generating supply portion 19, is added to the output signal of the multiplier $25_1$ in the adder 26. When the outer signal is not inputted by the outer input terminal $20_2$, the output signal of the multiplier $25_1$ passes the adder 26 in the original state.

Next, after the frequency components corresponding to each of the filter characteristics $27_1$–$27_n$ have been extracted from the output signal of the adder 26 by filters $27_1$–$27_n$, each level and envelop is extracted by envelop detectors $28_1$–$28_n$. After that, the extraction results $a_1$–$a_n$ of envelop detectors $28_1$–$28_n$ are each outputted as control parameters of tone generating device 22.

Thus, the proportional constants of multipliers $32_1$–$32_n$ of the filter portion of the physical model tone generating device indicated in FIG. 5 are controlled by parameters $a_1$–$a_n$ outputted by parameter generating supply portion 21.

By aforementioned action, the output level of the filter of the physical model tone generating device can be easily controlled by the sound of the player.

Though in the aforementioned preferred embodiment the characteristics of filters $27_1$–$27_n$ and the characteristics of filters $31_1$–$31_n$ are shown to be equal characteristics in the example, it is not necessary that they are equal characteristics. For example, shifting the frequency axis and compressing or extending the band of every filter is also allowed. Thus, the sound can be changed. Furthermore, it is also allowed to change the correspondence relation of parameters $a_1$–$a_n$ and filters $31_1$–$31_n$ corresponding to filters $27_1$–$27_n$. Thus, the frequency characteristics of filters $31_1$–$31_n$ can be changed to characteristics which are completely different to the former ones.

Figure 6:
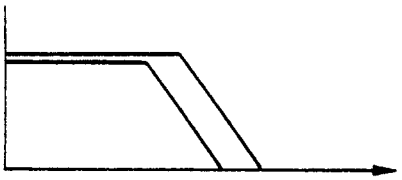
FIGS. 6 and 7 show another example of each of the filter characteristics $\mathbf{31}_1$–$\mathbf{31}_n$.
Figure 7:
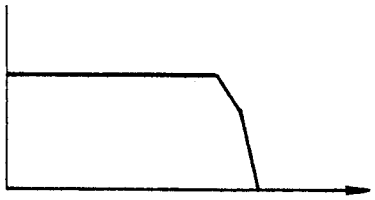

Though in the aforementioned preferred embodiment filters $31_1$–$31_n$ are shown as an example of a plurality of band filter groups, it is also possible, for example, to change it to the characteristic indicated in FIG. 7 by using low pass filters having different cut-off frequencies each, as indicated in FIG. 6, and by changing the characteristic of the shoulder formation by means of parameters $a_1$–$a_n$.

Though in the aforementioned preferred embodiment an example realizing the analysis of the frequency components of the outer signals inputted from outer signal input terminal 20 by a plurality of band pass filter groups $27_1$–$27_n$ having characteristics as shown in FIG. 3, a variety of common known spectral analysis methods, such as FFT-(fast Fourier transformation) analysis and analysis by linear prediction method may also be used as frequency analysis method.

What is claimed is:

1. An electronic musical instrument comprising:

excitation means for generating an excitation signal in response to performance information;

closed loop circuit into which said excitation signal is input and caused to circulate thereabout as a musical tone signal, the closed loop circuit having a delay means for delaying the musical tone signal for a predetermined time;

characteristics analysis means for analyzing an input signal to determine at least one characteristic thereof, and generating a control signal in response to the characteristics analysis result; and control means for controlling characteristics of the musical tone signal circulating in the closed loop circuit in response to the control signal.

2. An electronic musical instrument according to claim 1 wherein said closed loop circuit includes a plurality of filter means for filtering the musical tone signal based on predetermined frequency-characteristics, and wherein said control means includes level control means for controlling levels of musical tone signals output from the plurality of filter means in response to the control signal, whereupon the level-controlled musical tone signals mix and continue to circulate in the closed loop circuit.

3. An electronic musical instrument according to claim 2 wherein said characteristics analysis means comprises frequency component analysis means for analyzing frequency components of the input signal, and wherein said level control means controls the levels in response to the results of the analysis of the frequency components.

4. An electronic musical instrument according to claim 1 or 2 wherein said input signal includes a voice signal of a player.

5. An electronic musical instrument according to claim 2 wherein said plurality of filter means includes band-pass filters having predetermined center-frequencies.

6. An electronic musical instrument comprising:

excitation means for generating an excitation signal in response to performance information;

closed loop circuit into which said excitation signal is input and caused to circulate thereabout as a musical tone signal, the closed loop circuit having a delay means for delaying the musical tone signal for a predetermined time;

characteristics analysis means for analyzing an audio input signal and generating a control signal in response to the analysis result; and control means for controlling a characteristic of the musical tone signal circulating in the closed loop circuit in response to the control signal.

7. An electronic musical instrument comprising:

excitation means for generating an excitation signal in response to performance information;

closed loop circuit into which said excitation signal is input and caused to circulate thereabout as a musical tone signal, the closed loop circuit having a delay means for delaying the musical tone signal for a predetermined time;

characteristics analysis means for analyzing an input signal and generating at least one frequency dependent control signal in response to the characteristics analysis of said input signal; and control means for controlling characteristics of at least one determinable frequency range of the musical tone signal circulating in the closed loop circuit in response to the at least one frequency dependent control signal generated by said characteristics analysis means.

8. An electronic musical instrument according to claim 7 wherein said closed loop circuit includes a plurality of filter means for filtering the musical tone signal based on predetermined frequency-characteristics, and wherein said control means includes level control means for controlling levels of at least one of the musical tone signals output from the plurality of filter means in response to the at lease one frequency dependent control signal, wherein at least one level-controlled musical tone signal and any non-level-controlled signals are then mixed and continue to circulate in the closed loop circuit.

9. An electronic musical instrument according to claim 8 wherein said characteristics analysis means comprises frequency component analysis means for analyzing frequency components of the input signal, and wherein said level control means controls the levels in response to the results of the analysis of the frequency components.

10. An electronic musical instrument according to claim 8 wherein said plurality of filter means includes band-pass filters having predetermined center-frequencies.

* * * * *